US007116933B2

(12) United States Patent
Okada

(10) Patent No.: US 7,116,933 B2
(45) Date of Patent: Oct. 3, 2006

(54) DEVELOPING UNIT, IMAGE FORMING APPARATUS, AND DEVELOPING METHOD

(75) Inventor: Katsumi Okada, Osaka (JP)

(73) Assignee: Kyocera Mita Corporation, (JP)

( * ) Notice: Subject to any disclaimer, the term of this patent is extended or adjusted under 35 U.S.C. 154(b) by 197 days.

(21) Appl. No.: 10/948,560

(22) Filed: Sep. 23, 2004

(65) Prior Publication Data

US 2006/0062606 A1 Mar. 23, 2006

(51) Int. Cl.
*G03G 15/08* (2006.01)

(52) U.S. Cl. ..... 399/285

(58) Field of Classification Search ..... 399/267, 399/270, 285

See application file for complete search history.

(56) References Cited

U.S. PATENT DOCUMENTS 5,095,341 A * 3/1992 Yoshida et al. ..... 399/285
5,179,414 A * 1/1993 Bhagat ..... 399/270
5,182,601 A * 1/1993 Hodoshima et al. ..... 399/267
2005/0158061 A1* 7/2005 Do ..... 399/285

FOREIGN PATENT DOCUMENTS

EP 0 414 455 A2 2/1990
JP 2003-21966 1/2003

* cited by examiner

*Primary Examiner*—Susan Lee
(74) *Attorney, Agent, or Firm*—Gerald E. Hespos; Anthony J. Casella

(57) ABSTRACT

A developing unit is adapted to an image forming apparatus of an electrophotographic system that has a two component developing agent. The developing unit deposits a thin layer of toner on a developing roller by way of a magnetic brush on a magnetic roller. The toner then is transferred from the developing roller to a photosensitive drum. Developing bias voltages applied to the rollers have DC and AC components. Thus, electric current alternately flows in the magnetic roller and the developing roller to accelerate toner transfer. Sufficient toner is supplied from the magnetic roller to the developing roller, and sufficient toner is recovered from the developing roller to the magnetic roller. This arrangement lowers the amplitude of the AC bias voltage, thereby eliminating an influence on the photosensitive drum. Further, the frequencies of the AC bias voltages are constant. Thus AC bias voltage generating circuits have a low cost.

10 Claims, 7 Drawing Sheets

DEVELOPING UNIT, IMAGE FORMING APPARATUS, AND DEVELOPING METHOD

BACKGROUND OF THE INVENTION

1. Field of the Invention

The present invention relates to a developing unit and a developing method adapted to an image forming apparatus such as a copier, a facsimile machine, and a printer, as well as to the image forming apparatus incorporated with the developing unit or employing the developing method, and particularly to an arrangement for generating a developing bias voltage in a so-called hybrid developer of an electrophotographic system.

2. Description of the Related Art

The hybrid developer incorporated with dual rollers consisting of a magnetic roller and a developing roller has been conventionally employed as non-contact developing means in which a single component developing agent is used. In recent years, use of the hybrid developer as developing means in a tandem-color image forming apparatus in which a two component developing agent is used has been popular in light of the merit that toner images are relatively accurately superimposed one over the other. According to the conventional art, although deposition of a thin toner layer on the developing roller is feasible, it is difficult to scrape and feed the toner which has once been deposited on the developing roller back to the magnetic roller because the toner of high chargeability (charged amount) is electrically attracted to the developing roller, with the result that the toner cannot be sufficiently recovered merely with use of a magnetic brush formed on the magnetic roller. Thus, it is likely that drawbacks such as fog, ghost image, unwanted toner scattering, density distribution variation, and toner transfer failure may take place owing to toner residues which have been left on the developing roller.

In order to solve the above drawbacks, it is necessary to generate a strong alternate current (AC) field between the developing roller and the magnetic roller, or generate an electric potential between the developing roller and the magnetic roller by application of a high voltage of direct current (DC) to the developing roller during a non image formation period. In the above technique, however, application of a high DC voltage may adversely affect discharging operation onto a photosensitive drum or a charging distribution of toner over the developing roller due to instantaneous mixing of the toner.

Japanese Unexamined Patent Publication No. HEI 3-113474 proposes a so-called powder cloud development, as a measure for solving the above drawbacks. According to the method, a sub electrode including an electrode wire is provided between a developing roller and a photosensitive drum, and a toner cloud is generated by applying a weak AC field to the sub electrode. This method, however, is of less use, because the electrode wire of the sub electrode is likely to be smeared, and image formability may be degraded due to vibrations generated by the AC field.

Japanese Unexamined Patent Publication No. 2003-21966 proposes an arrangement in which toner circulation between a developing roller and a magnetic roller is accelerated by varying the duty ratio of the AC voltage to be applied to the developing roller while keeping the developing roller and the magnetic roller in an equipotential state. A large amplitude of the AC voltage is required in order to carry out satisfactory toner circulation between the developing roller and the magnetic roller, which may influence the physical deterioration on the photosensitive drum.

There have been proposed various arrangements such as a special structure for generating an AC field, and a method for controlling an application voltage, other than the above. These arrangements, however, make the construction of a developing unit complicated, and raise the cost relating to a developing bias voltage generator.

As mentioned above, the respective conventional arrangements have been proposed in an attempt to prevent deterioration on image density or developing performance. In these conventional arrangements, complicated parts or a large number of parts are required. In addition to the above, control of the developing bias voltage is cumbersome. Thus, the cost relating to the developing unit including the developing bias voltage generator is unavoidably raised.

SUMMARY OF THE INVENTION

In view of the problems residing in the prior art, an object of the present invention is to provide a cost reductive developing unit, image forming apparatus, and developing method.

A developing unit according to an aspect of the present invention is constructed such that a thin layer of a developing agent is deposited on a developing roller by way of a magnetic brush formed on a magnetic roller, and the developing agent is transferred from the developing roller to a photosensitive drum for development. The developing unit comprises: first DC bias voltage generating means which generates a first DC bias voltage to be applied to the magnetic roller; second DC bias voltage generating means which generates a second DC bias voltage to be applied to the developing roller; first AC bias voltage generating means which generates a first AC bias voltage to be applied to the magnetic roller, the first AC bias voltage being superimposed on the first DC bias voltage; and second AC bias voltage generating means which generates a second AC bias voltage to be applied to the developing roller, the second AC bias voltage being superimposed on the second DC bias voltage, wherein the first AC bias voltage and the second AC bias voltage have frequencies identical to each other and phases reversed to each other.

In the above arrangement, an electric current alternately flows in the magnetic roller and the developing roller to accelerate transfer of the developing agent, thereby enabling to carry out sufficient supply of the developing agent from the magnetic roller to the developing roller, and sufficient recovery of the developing agent from the developing roller to the magnetic roller with application of a relatively low bias voltage. Accordingly, as compared with a case of applying an AC bias voltage merely to the developing roller, this arrangement enables to lower the amplitude of the AC bias voltage to thereby eliminate an influence on the photosensitive drum. Further, since the frequencies of the AC bias voltages to be applied to the magnetic roller and the developing roller are constant, this arrangement enables to produce the first and second AC bias voltage generating means at a low cost.

An image forming apparatus according to another aspect of the present invention is for use with a developing unit constructed such that a thin layer of a developing agent is deposited on a developing roller by way of a magnetic brush formed on a magnetic roller, and the developing agent is transferred from the developing roller to a photosensitive drum for development. The developing unit comprises: first DC bias voltage generating means which generates a first DC bias voltage to be applied to the magnetic roller; second DC bias voltage generating means which generates a second DC bias voltage to be applied to the developing roller; first AC bias voltage generating means which generates a first AC bias voltage to be applied to the magnetic roller, the first AC bias voltage being superimposed on the first DC bias voltage; and second AC bias voltage generating means which generates a second AC bias voltage to be applied to the developing roller, the second AC bias voltage being superimposed on the second DC bias voltage, wherein the first AC bias voltage and the second AC bias voltage have frequencies identical to each other and phases reversed to each other.

In the above arrangement, the developing unit for use in the image forming apparatus can be produced at a low cost, wherein sufficient supply of the developing agent from the magnetic roller to the developing roller, and sufficient recovery of the developing agent from the developing roller to the magnetic roller are carried out.

A development method according to yet another aspect of the present invention comprises depositing a thin layer of a developing agent on a developing roller by way of a magnetic brush formed on a magnetic roller, and transferring the developing agent from the developing roller to a photosensitive drum for development, wherein a bias voltage to be applied to the magnetic roller is generated by superimposing a first AC bias voltage on a first DC bias voltage; a bias voltage to be applied to the developing roller is generated by superimposing a second AC bias voltage on a second DC bias voltage; and the first AC bias voltage to be applied to the magnetic roller and the second AC bias voltage to be applied to the developing roller have frequencies identical to each other and phases reversed to each other.

In the above method, an electric current alternately flows in the magnetic roller and the developing roller to accelerate transfer of the developing agent, thereby enabling to carry out sufficient supply of the developing agent from the magnetic roller to the developing roller, and sufficient recovery of the developing agent from the developing roller to the magnetic roller with application of a relatively low bias voltage. Accordingly, as compared with a case of applying an AC bias voltage merely to the developing roller, this arrangement enables to lower the amplitude of the AC bias voltage to thereby eliminate an influence on the photosensitive drum. Further, since the frequencies of the AC bias voltages to be applied to the magnetic roller and the developing roller are constant, this arrangement enables to produce the AC bias voltage generating means at a low cost.

These and other objects, features and advantages of the present invention will become more apparent upon reading of the following detailed description along with the accompanying drawings.

DETAILED DESCRIPTION OF THE PREFERRED EMBODIMENTS

In the following, preferred embodiments of the present invention are described referring to the accompanying drawings. It should be noted that the dimensions, configuration, and relative disposition of the constituent elements recited in the embodiments of the present invention are merely an illustrative example, which are not intended to confine the scope of the present invention unless otherwise specifically mentioned.

Figure 1:
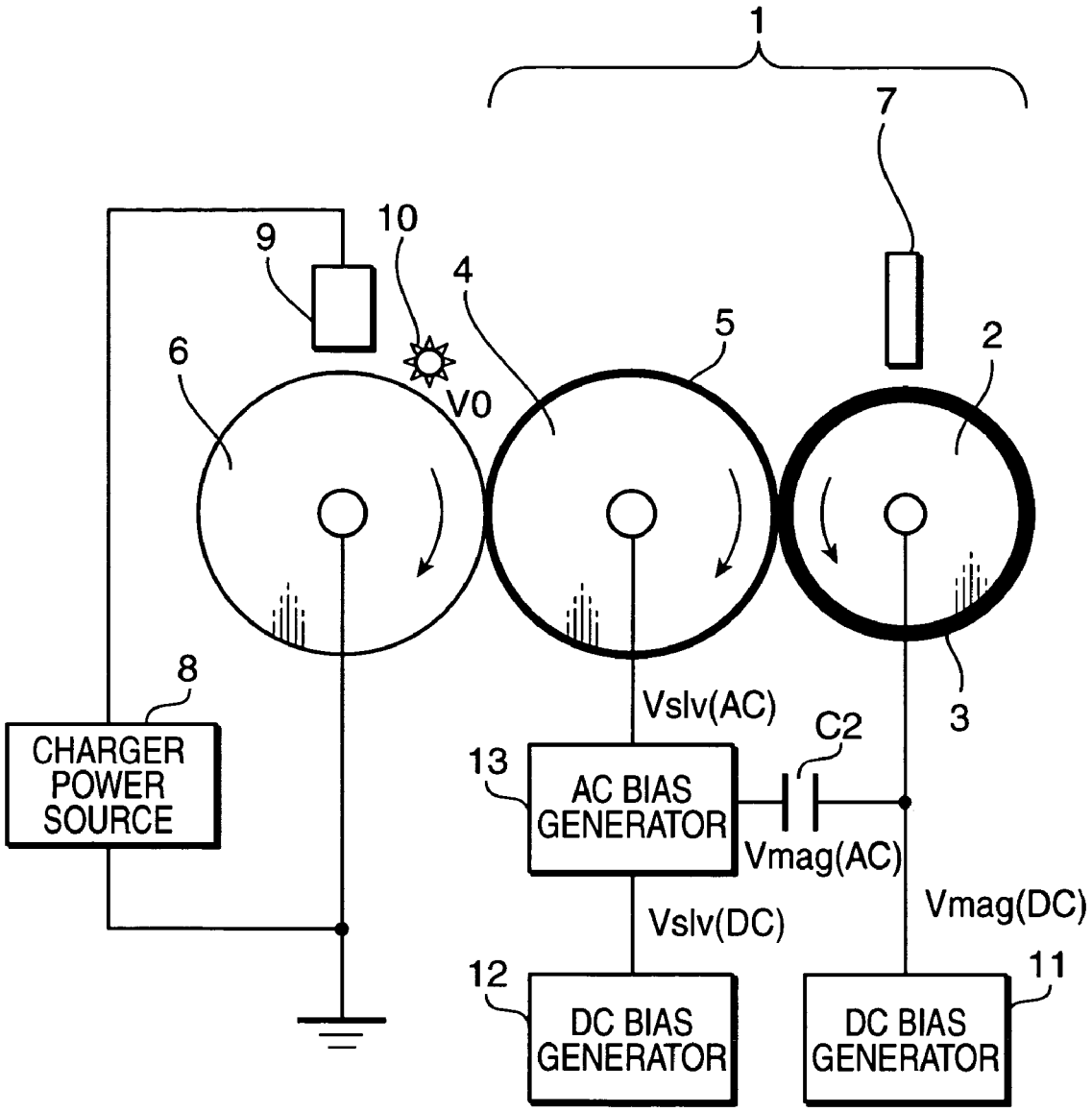
FIG. 1 is an illustration schematically showing a developing unit and its vicinity in a first embodiment of the present invention.

FIG. 1 is an illustration schematically showing a developing unit 1 and its vicinity as a first embodiment of the present invention. The developing unit 1 is adapted to an image forming apparatus of an electrophotographic system in which a two component developing agent is used. The developing unit 1 is a so-called hybrid developer constructed such that a thin layer 5 of toner is deposited on a developing roller 4 by way of a magnetic brush 3 formed on a magnetic roller 2 to transfer the toner from the developing roller 4 to a photosensitive drum 6.

The developing unit 1 has a DC bias voltage generating circuit 11 for generating a DC bias voltage Vmag(DC), which is a first DC bias voltage to be applied to the magnetic roller 2, a DC bias voltage generating circuit 12 for generating a DC bias voltage Vslv(DC), which is a second DC bias voltage to be applied to the developing roller 4, and an AC bias voltage generating circuit 13 for generating an AC bias voltage Vmag(AC), which is a first AC bias voltage, and an AC bias voltage Vslv(AC), which is a second AC bias voltage. The DC bias voltage Vmag(DC) generated in the DC bias voltage generating circuit 11 is directly applied to the magnetic roller 2. The AC bias voltage Vmag(AC) generated in the AC bias voltage generating circuit 13 is applied to a power source line connecting the DC bias voltage generating circuit 11 and the magnetic roller 2 via a coupling capacitor C2, and superimposed on the DC bias voltage Vmag(DC). The DC bias voltage Vslv(DC) generated in the DC bias voltage generating circuit 12 is outputted to the AC bias voltage generating circuit 13, and superimposed on the AC bias voltage Vslv(AC) generated in the AC bias voltage generating circuit 13. The DC bias voltage Vslv(DC) with the AC bias voltage Vslv(AC) being superimposed thereon is applied to the developing roller 4.

The height of the magnetic brush 3 formed on the magnetic roller 2 is regulated by a regulating blade 7. Before light exposure, the photosensitive drum 6 is charged to a predetermined high electric potential (in this embodiment, positive potential) by a charger 9 whose power is supplied from a charger power source 8. The electric potential is lowered by irradiation of light that is emitted from a laser light source 10 and modulated based on image signals, whereby an electrostatic latent image of potential V0 is formed on the surface of the photosensitive drum 6. Since the surface of the photosensitive drum 6 is charged to the high positive potential by the charger 9, and toner is electrically attracted to the drum surface where the potential is lowered by the light exposure, the toner is positively charged. In the following, a case is described where the positively charged toner is used.

Figure 2:
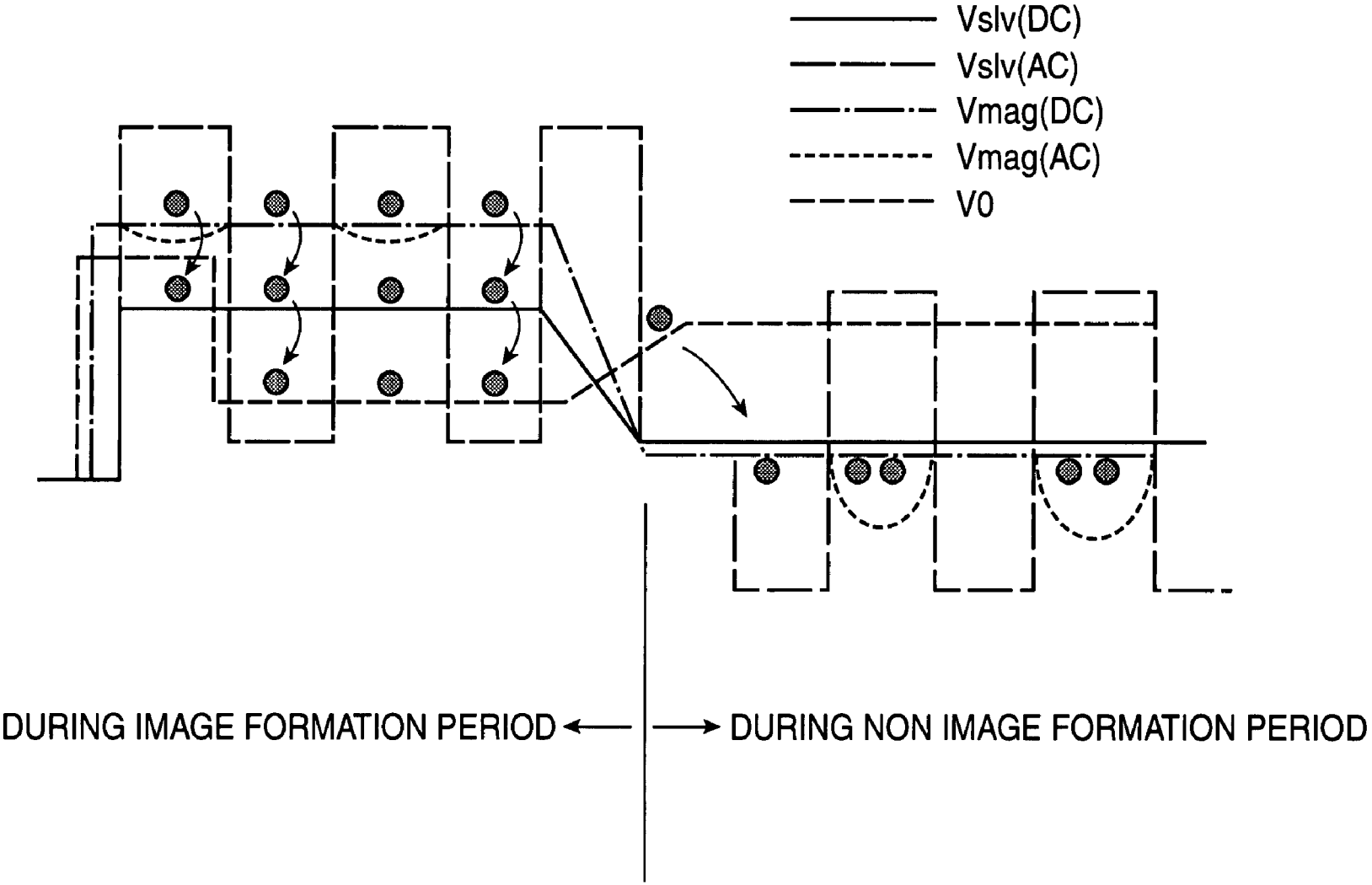
FIG. 2 is a waveform diagram for explaining a developing method according to which the developing unit as shown in FIG. 1 is used.

FIG. 2 is a waveform diagram for explaining a developing method according to which the developing unit 1 is used.

During an image formation period, the charging potential of the magnetic roller 2 is kept to the level of the DC bias voltage Vmag(DC) which is higher than the ground level, with the AC bias voltage Vmag(AC) being set to 0. On the other hand, the charging potential of the developing roller 4 changes within the amplitude of the AC bias voltage Vslv (AC), while setting the DC bias voltage Vslv(DC) which is higher than the ground level and lower than the DC bias voltage Vmag(DC) as a reference level. The charging potential V0 of the photosensitive drum 6 is lower than the DC bias voltage Vmag(DC) and higher than the DC bias voltage Vslv(DC) in the non image formation region thereof, and lower than the DC bias voltage Vmag(DC) and the DC bias voltage Vslv(DC) in the image formation region thereof. Since the positively charged toner is transferred from the region of a high DC potential to the region of a low DC potential, the positively charged toner is transferred from the magnetic roller 2 to the photosensitive drum 6 via the developing roller 4, in view of the relation: Vmag(DC)>Vslv (DC)>V0 with respect to the potential of the image formation region on the photosensitive drum 6. At this time, the AC bias voltage Vslv(AC) is applied to the developing roller 4 so as to weaken the electrical attracting force toward the developing roller 4 and to easily transfer the toner to the photosensitive drum 6.

During a non image formation period, the charging potential V0 of the photosensitive drum 6 is kept high because no image signal is outputted. There is proposed an arrangement: Vmag(DC)<Vslv(DC)<V0, which is an arrangement opposite to the arrangement in the image formation period in an attempt to recover toner that has not been used in image development. However, this method is not practical because the toner on the developing roller 4 and the toner on the magnetic roller 2 having different charged amounts from each other are instantaneously mixed together. Repeated application of an electrical stress onto the magnetic powder (carrier) or toner may greatly vary the charged amount of the toner, and undesirably widen the charged amount distribution. As a result, the toner may be reversely charged, thereby resulting in unwanted toner scattering or image density deterioration at the time of printing.

Considering the above drawbacks, in the embodiment of the present invention, during the non image formation period, the DC bias voltages Vmag(DC) and Vslv(DC) are set to a low potential and substantially equal to each other: Vmag(DC)≈Vslv(DC), so that there is no or less variation in charged amount distribution of the toner during circulation of the toner between the developing roller 4 and the magnetic roller 2. This arrangement enables to prevent generation of a residual image resulting from continuous development, and to secure long-term and stable image formation by supply of the stably charged toner onto the developing roller 4.

Further, in this embodiment, the AC bias voltage Vslv (AC) is superimposed on the DC bias voltage Vslv(DC), while extracting a negative component of the AC bias voltage Vmag(AC) to be superimposed on the DC bias voltage Vmag(DC). Thereby, as is obviously shown in the potential distribution of FIG. 2, the positively charged toner can be efficiently recovered onto the magnetic roller 2.

In this way, the developing bias voltage Vmag to be applied to the magnetic roller 2 is composed of the DC component and the AC component, and the AC bias voltage Vmag(AC) is set to a voltage having a frequency identical to the frequency of the AC bias voltage Vslv(AC) to be applied to the developing roller 4 and a phase reversed thereto. This arrangement enables to lower the amplitudes of the AC bias voltages Vmag(AC), Vslv(AC) to thereby eliminate an influence on the photosensitive drum 6, and to make the frequencies of the AC bias voltages Vmag(AC), Vslv(AC) constant to thereby reduce the cost relating to the AC bias voltage generating circuit 13, as compared with the conventional arrangement in which an AC bias voltage is applied merely to the developing roller 4.

Figure 3:
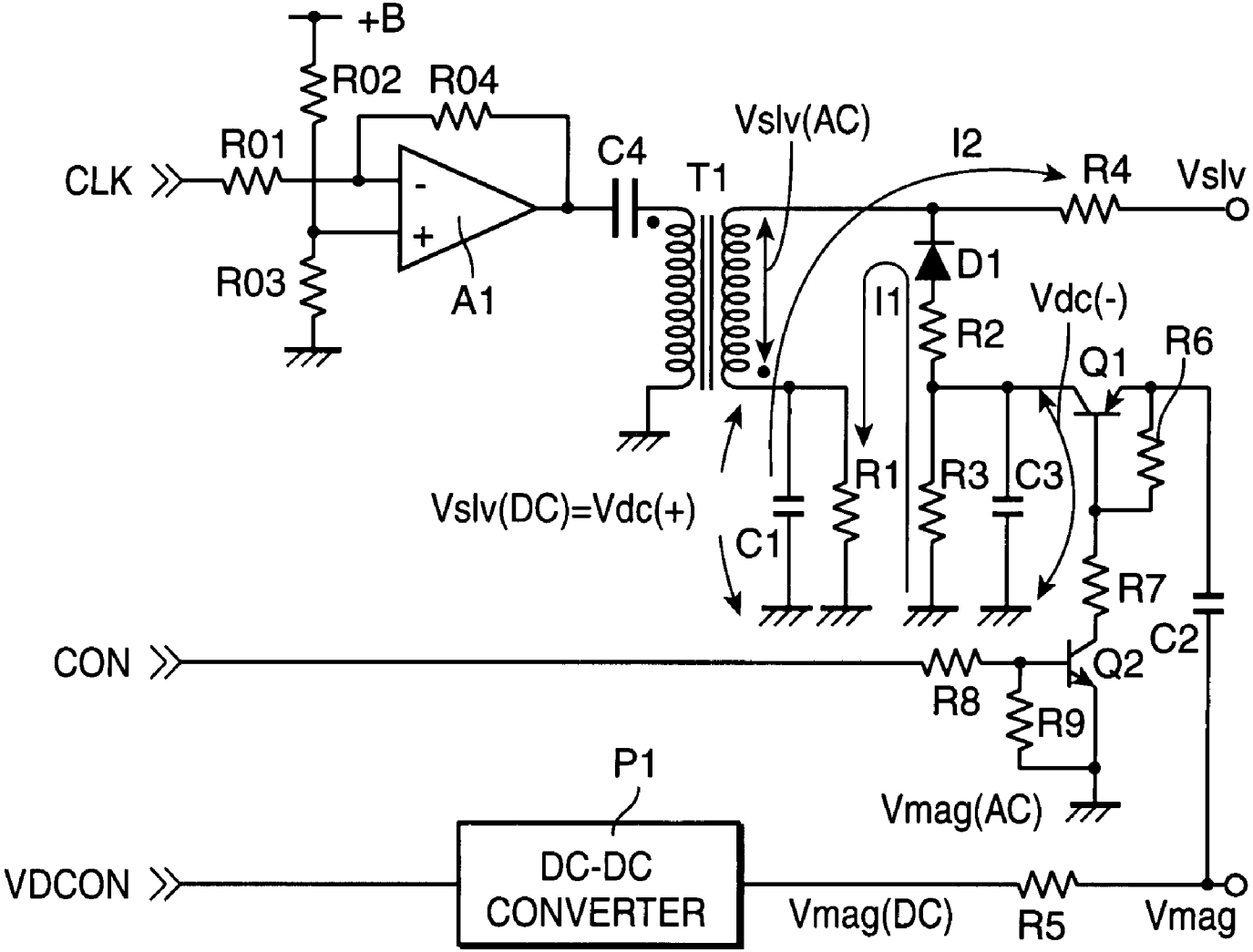
FIG. 3 is an electric circuitry diagram exemplifying a bias voltage generator in the developing unit as shown in FIG. 1.

FIG. 3 is an electric circuitry diagram showing an example of a bias voltage generator constituted of the AC bias voltage generating circuit 13 and the DC bias voltage generating circuit 12, as well as the DC bias voltage generating circuit 11. The bias voltage generator shown in FIG. 3 is constructed as a single booster circuit using a transducer T1. The bias voltage generator generally includes: a signal source of an AC signal to be boosted; the transducer T1; a rectifying diode D1; a resistor R1 provided at one end of a series circuit constituted of the transducer T1; resistors R2, R3 provided at a corresponding one end of a series circuit constituted of the rectifying diode D1; capacitors C1, C3 provided in parallel with the resistors R1, R3, respectively; a switching element Q1 for passing a terminal voltage of the resistor R3 during the non image formation period; and the coupling capacitor C2 for supplying the voltage passing the switching element Q1 to the power source line connecting a DC—DC converter P1 serving as the DC bias voltage generating circuit 11 and the magnetic roller 2. The coupling capacitor C2 generates a bias voltage Vmag to be applied to the magnetic roller 2 by superimposing the voltage passing the switching element Q1, as the AC bias voltage Vmag (AC), on the DC bias voltage Vmag(DC).

The signal source constituted of an amplifier A1, an input resistor R01 for the amplifier A1, voltage dividing resistors R02, R03, a feedback resistor R04, and a coupling capacitor C4 is arranged on the primary end of the transducer T1. The signal source is configured such that the amplifier A1 amplifies an input AC signal CLK to be inputted to the bias voltage generator via the input resistor R01 by comparing the input AC signal CLK with a value obtained by dividing the voltage (power voltage +B) by the voltage dividing resistors R02, R03, so that the amplified input AC signal CLK is supplied to the primary winding of the transducer T1 via the coupling capacitor C4. The ratio of the number of the primary winding of the transducer T1 to the number of the secondary winding thereof is 1:100. Thus, the output amplitude of the amplifier A1 is transmitted to the secondary end of the transducer T1 after being amplified by 100.

Observing the secondary end of the transducer T1, the connecting point of the secondary winding of the transducer T1 and the rectifying diode D1 serves as an output end to the developing roller 4. The voltage at the connecting point is outputted as a bias voltage Vslv via a resistor R4. In the bias voltage generator shown in FIG. 3, the side of the rectifying diode D1 corresponding to the side of the primary end of the transducer T1 functions as a cathode, and the side thereof corresponding to the side of the resistor R2 functions as an anode. In this arrangement, the terminal voltage of the resistor R3 is lowered than the ground potential level, and the switching element Q1 constitutes a p-transistor. A bias resistor R6 is provided between the base and the emitter of the switching element Q1, with the base being grounded via a resistor R7 and an n-transistor Q2. The transistor Q2 is on/off controlled based on a control signal CON which is supplied via bias resistors R8, R9.

Figure 4:
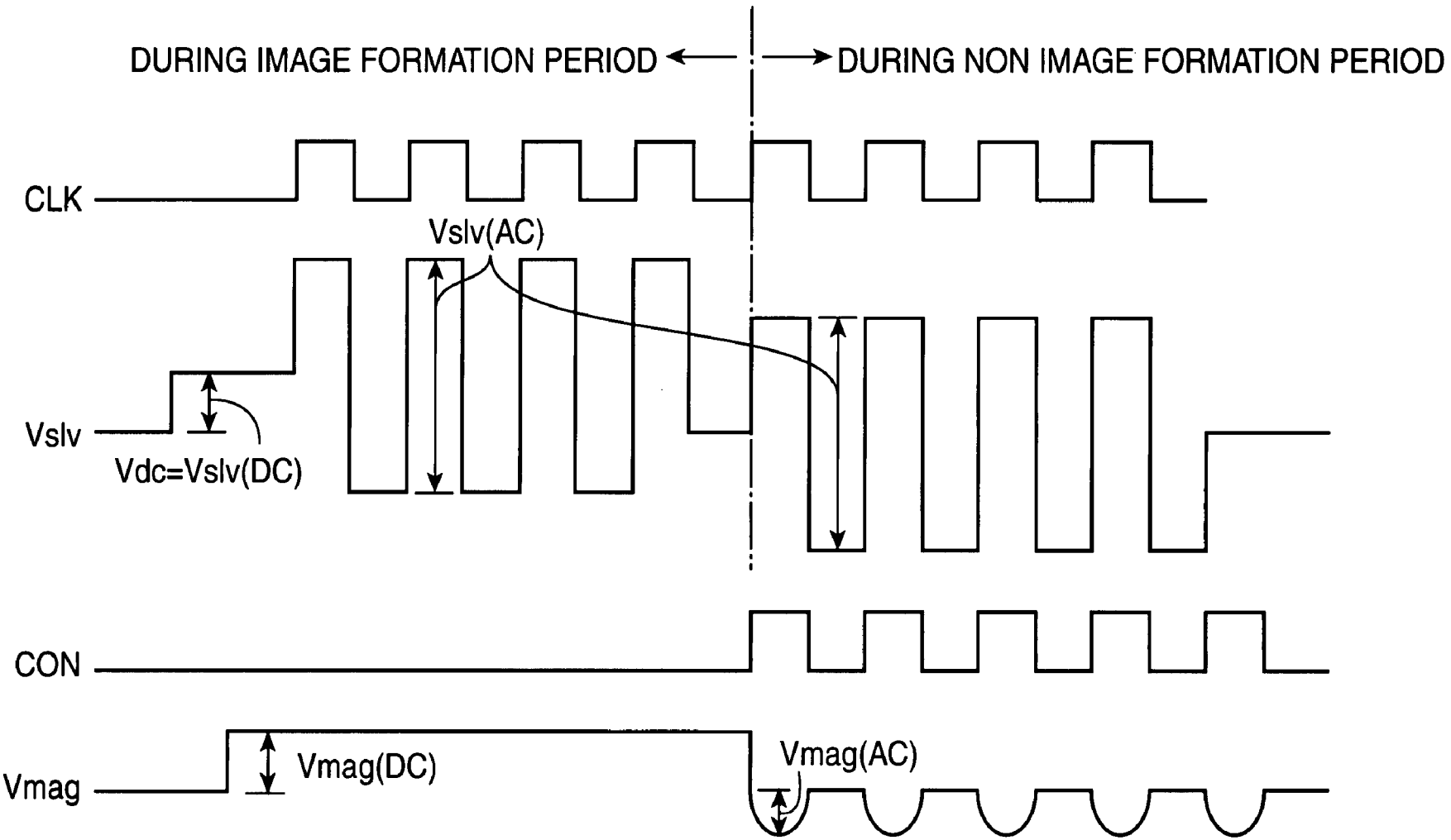
FIG. 4 is a waveform diagram for explaining an operation of the bias voltage generator as shown in FIG. 3.

FIG. 4 is a waveform diagram for explaining an operation of the bias voltage generator shown in FIG. 3. During an image formation period, the control signal CON is kept to a low level. Accordingly, the transistor Q2 is kept in an OFF-state, and the transistor Q1 is kept in an OFF-state. As a result, the input AC signal CLK is set to a high level. While an upward voltage is applied to the primary winding of the transducer T1 in FIG. 3, a downward voltage is induced in the secondary winding of the transducer T1. Thereby, an electric current flows along the route denoted by the arrow I1 (see FIG. 3), namely, from secondary winding→capacitor C1 and resistor R1→capacitor C3 and resistor R3→resistor R2→rectifying diode D1→to secondary winding. The capacitors C3, C1 are charged with polarities opposite to each other. The charged voltages Vdc(−), Vdc(+) make a difference substantially corresponding to lowering of a forward voltage of the rectifying diode D1. Accordingly, $|Vdc(-)| \approx |Vdc(+)|$. The charged voltage Vdc(+) of the capacitor C1 serves as the DC bias voltage Vslv(DC), and the bias voltage Vslv to be applied to the developing roller 4 is a value obtained by subtracting the induced voltage in the secondary winding of the transducer T1 from the charged voltage Vdc(+).

On the other hand, while the input AC signal CLK is set to a low level, and a downward voltage is applied to the primary winding of the transducer T1, an upward voltage is induced in the secondary winding of the transducer T1. Thereby, an electric current flows along the route denoted by the arrow I2 (see FIG. 3), namely, from secondary winding→resistor R4→developing roller 4→capacitor C1 and resistor R1→to secondary winding. The capacitor C3 is neither charged nor discharged by the induced voltage, and the capacitor C1 is discharged. The bias voltage Vslv to be applied to the developing roller 4 is a sum of the charged voltage Vdc(+) and the induced voltage in the secondary winding of the transducer T1. In this way, the bias voltage Vslv to be applied to the developing roller 4 is obtained by superimposing the AC bias voltage Vslv(AC) derived from the induced voltage in the secondary winding of the transducer T1 on the charged voltage Vdc(+), namely, the DC bias voltage Vslv(DC).

The DC—DC converter P1 is controlled by a control signal VDCON. A voltage boosting operation is conducted during the image formation period, with the result that the DC bias voltage Vmag(DC), which is an output voltage of the DC—DC converter P1, is set to a high level. The output voltage is applied to the magnetic roller 2 via a resistor R5.

On the other hand, during the non image formation period, the control signal CON is synchronous with the input AC signal CLK. Accordingly, while the input AC signal CLK is kept to a high level, the control signal CON is also kept to a high level, with the result that the transistor Q2 is set to an ON-state, and the transistor Q1 is set to an ON-state. At this time, while an upward voltage is applied to the primary winding of the transducer T1, and a downward voltage is induced in the secondary winding of the transducer T1, an electric current flows along the route denoted by the arrow I1 (see FIG. 3), namely, from secondary winding→resistor R1→resistor R3→resistor R2→rectifying diode D1→to secondary winding. At this time, the capacitor C3 is discharged via the transistor Q1 and the coupling capacitor C2. Accordingly, the charged voltages Vdc(−), Vdc(+) come closer to the DC bias voltage Vmag(DC), which is an output voltage of the DC—DC converter P1. At this time, the DC—DC converter P1 makes the boosting level lower by the control signal VDCON. Then, the DC bias voltage Vmag(DC) is set low, or if the boosting operation is suspended, for instance, the DC bias voltage Vmag(DC) is lowered to the ground level. As a result, the DC bias voltage Vslv(DC) is substantially identical to the DC bias voltage Vmag(DC), namely, both the DC bias voltages Vslv(DC) and Vmag(DC) are lowered. At this time, the bias voltage Vslv to be applied to the developing roller 4 is a value obtained by subtracting the induced voltage in the secondary winding of the transducer T1 from the DC bias voltage Vslv(DC), in other words, the DC bias voltage Vmag(DC).

On the other hand, while the input AC signal CLK is set to a low level, and a downward voltage is applied to the primary winding of the transducer T1, an upward voltage is induced in the secondary winding of the transducer T1. Thereby, an electric current flows along the route denoted by the arrow I2 (see FIG. 3), namely, from secondary winding→resistor R4→developing roller 4→resistor R1→to secondary winding. The bias voltage Vslv to be applied to the developing roller 4 is a value obtained by adding the induced voltage in the secondary winding of the transducer T1 to the DC bias voltage Vslv(DC), in other words, the DC bias voltage Vmag(DC). In this way, the bias voltage Vslv to be applied to the developing roller 4 is obtained by superimposing the AC bias voltage Vslv(AC) derived from the induced voltage in the secondary winding of the transducer T1 on the DC bias voltage Vslv(DC), namely, the DC bias voltage Vmag(DC).

The above arrangement makes it possible to configure the bias voltage generator merely with use of the single transducer T1, in which the DC bias voltage Vmag(DC) to be applied to the magnetic roller 2 and the DC bias voltage Vslv(DC) to be applied to the developing roller 4 are set substantially equipotential to each other, and that merely the negative component of the AC bias voltage Vmag(AC) is extracted for output during the non image formation period and a period between jobs of an image forming apparatus.

Figure 5:
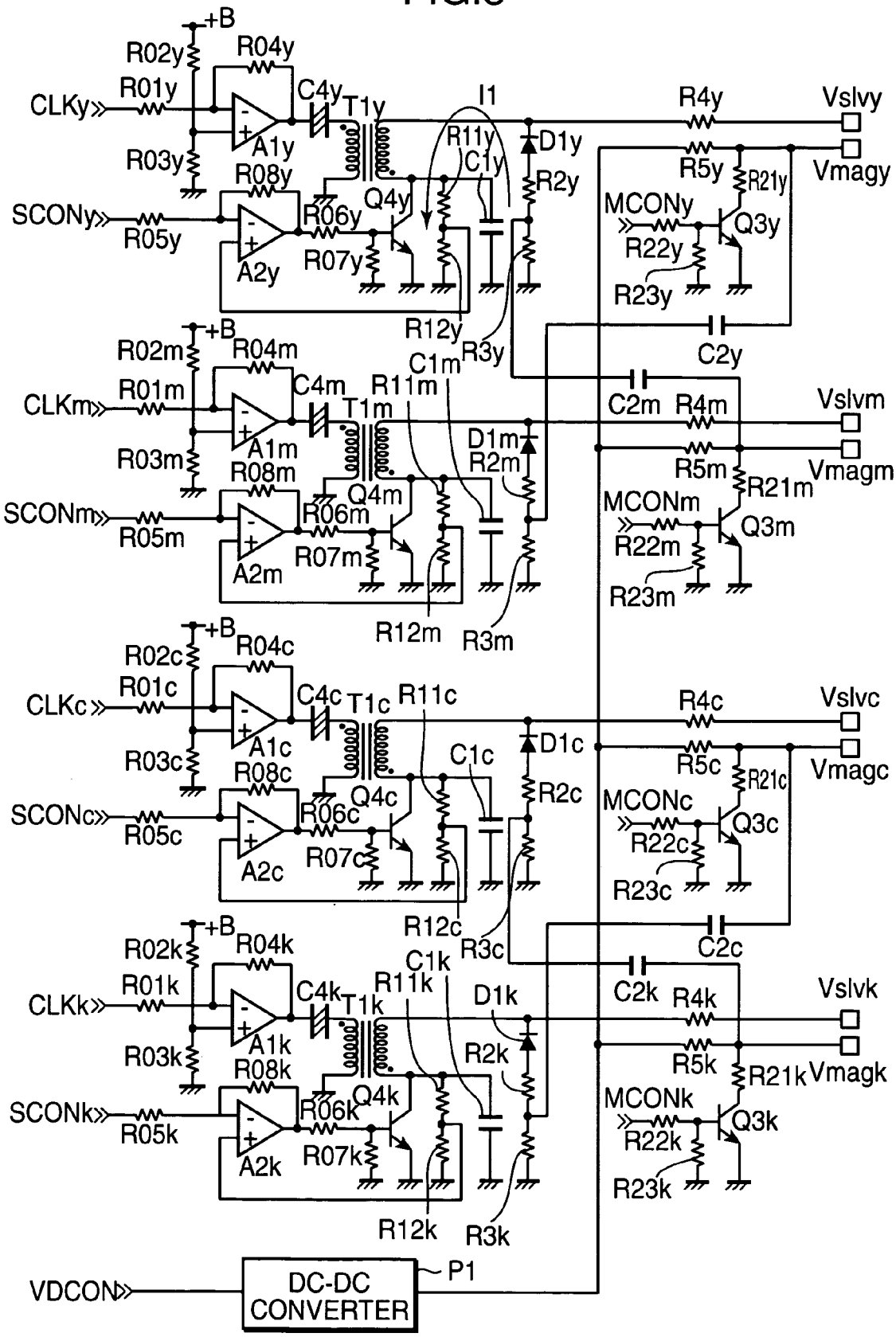
FIG. 5 is an electric circuitry diagram of a bias voltage generator in a second embodiment of the present invention.

FIG. 5 is an electric circuitry diagram of a bias voltage generator as a second embodiment of the present invention. The bias voltage generator in the second embodiment is different from the bias voltage generator in the first embodiment in the following points. The bias voltage generator in the second embodiment is used in a full-color reproducible image forming apparatus of a tandem system, in which four color components of yellow, magenta, cyan, and black are used. The constituent elements in FIG. 5 equivalent to those in FIG. 3 are denoted by the like reference numerals with suffixes y, m, c, k representing the respective colors being attached thereto. However, as far as no specific mention is necessary, the constituent elements in the second embodiment are described with the suffixes y, m, c, k omitted.

The bias voltage generator in this embodiment is configured such that an output end of a resistor R5 through which an output voltage from a DC—DC converter P1 is outputted to a magnetic roller 2 is grounded via a resistor R21 and a transistor Q3. The transistor Q3 is on/off controlled based on a control signal MCON which is supplied via bias resistors R22, R23.

Further, in the second embodiment, a transistor Q4 is provided in parallel with a capacitor C1 in such a manner as to short-circuit between the terminals of the capacitor C1. A base current of the transistor Q4 is controlled by a calculation amplifier A2, and a voltage between the terminals of the capacitor C1 is lowered by a control signal SCON during a non image formation period and a period between jobs of the image forming apparatus. For instance, if a short circuit takes place, the current flowing along the route denoted by the arrow I1 in FIG. 5 is bi-passed by the transistor Q4, thereby making Vslv(DC)=0V. The control signal SCON is supplied to an input terminal (in FIG. 5, negative input terminal) of the calculation amplifier A2 via an input resistor R05, and is compared with a voltage-divided value of a charged voltage of the capacitor C1 which is obtained at the connecting point of series resistors R11, R12 by dividing a resistor R1 (see FIG. 3) constituted of the series resistors R11, R12 by the series resistors R11, R12. As a result of the comparison, as the control signal SCON is higher than the voltage-divided value of the charged voltage of the capacitor C1, the calculation amplifier A2 raises the base voltage of the transistor Q4, and lowers the charged voltage of the capacitor C1. In this way, a DC bias voltage Vslv(DC) to be applied to a developing roller 4 is controlled. While the transistor Q4 is kept in an ON-state, the capacitor C1 functions to eliminate an AC output loss by lowering the AC impedance at the secondary end of a transducer T1. The output from the calculation amplifier A2 is supplied to the base of the transistor Q4 via resistors R06, R07, and also fed back to the negative input terminal of the calculation amplifier A2 via a feedback resistor R08.

As shown in FIG. 5, the bias voltage generator in this embodiment is constituted of four bias voltage generating circuits adapted to the respective four colors, namely, yellow (y), magenta (m), cyan (c), and black (k), with each two of the bias voltage generating circuits making a pair. In FIG. 5, the bias voltage generating circuits for yellow and magenta make a pair, and the bias voltage generating circuits for cyan and black make a pair. A coupling capacitor C2 is connected between resistors R2, R3 of the counterpart bias voltage generating circuit in each of the bias voltage generating circuit pairs. Specifically, in FIG. 5, a coupling capacitor C2*y* is connected between resistors R2*m*, R3*m*, and a coupling capacitor C2*m* is connected between resistors R2*y*, R3*y*, while a coupling capacitor C2*c* is connected between resistors R2*k*, R3*k*, and a coupling capacitor C2*k* is connected between resistors R2*c*, R3*c*, respectively. Further, phases of input AC signals CLK are reversed to each other in each of the bias voltage generating circuit pairs. In this arrangement, a rectangular wave on the low-level side generated at the anode of a diode D1 can be extracted in the counterpart bias voltage generating circuit of the bias voltage generating circuit pair without using a capacitor C3. In view of this, the capacitor C3 is omitted in this embodiment.

Figure 6:
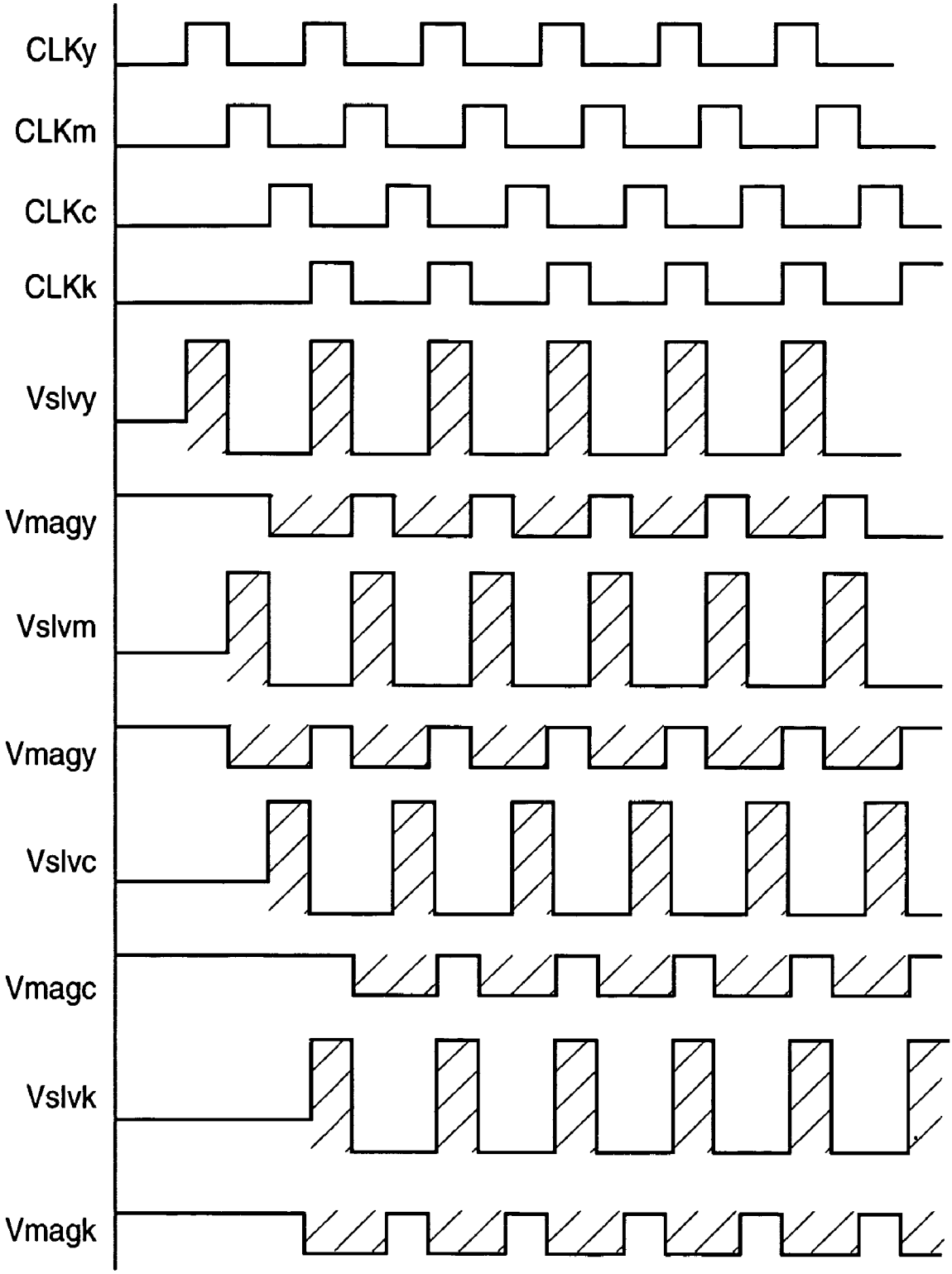
FIG. 6 is a waveform diagram for explaining an operation of the bias voltage generator as shown in FIG. 5.

FIG. 6 is a waveform diagram for explaining an operation of the bias voltage generator in the second embodiment. Phases of input AC signals CLKy, CLKm, CLKc, CLKk of the respective bias voltage generating circuits are displaced from each other by ⅓ cycle at a pulse of duty cycle 30%. Such a phase displacement is conducted because extracting an AC bias voltage Vmag(AC)y to be superimposed on a DC bias voltage Vmag(DC)y to be applied to the magnetic roller for use in printing an image of yellow, for example, from a charged voltage of the capacitor C3 for generating a bias voltage to be applied to the developing roller for use in printing the image of yellow makes the phase of the AC bias voltage Vmag(AC)y coincident with the phase of a DC bias voltage Vslv(DC)y, which obstructs generating a required phase of the AC bias voltage Vmag(AC)y. Specifically, whereas in the first embodiment, as shown in FIG. 3, the phase of the AC bias voltage Vmag(AC) to be applied to the magnetic roller 2 is controlled by the arrangement comprising the switching element Q1 and the transistor Q2, in the second embodiment, as shown in FIG. 5, the pulses of the input AC signals CLK are not overlapped with each other in each of the bias voltage generating circuit pairs, and accordingly, the phases of the resultant signals are displaced from each other due to lack of the arrangement comprising the switching element Q1 and the transistor Q2.

In view of the above, taking an example of the magnetic roller for use in printing an image of yellow, inputting the input AC signal CLKm adjacent the input AC signal CLKy with the phase thereof delayed relative thereto by a predetermined cycle, and driving the primary end of a transducer T1*m* with the input AC signal CLKm being amplified by an amplifier A1*m* enables to generate an AC bias voltage Vslv(AC)m whose phase is delayed relative to an AC bias voltage Vslv(AC)y at the secondary end of a transducer T1*m*. The AC bias voltage Vslv(AC)m is extracted by the coupling capacitor C2*y*, and is superimposed on the DC bias voltage Vmag(DC)y, as the AC bias voltage Vmag(AC)y. Conversely, taking an example of the magnetic roller for use in printing an image of magenta, when the input AC signal CLKy whose phase is advanced to the adjacent input AC signal CLKm is supplied from an amplifier A1*y* to a transducer T1*y*, the AC bias voltage Vslv(AC)y whose phase is advanced to the AC bias voltage Vslv(AC)m is generated at the secondary end of the transducer T1*y*. The AC bias voltage Vslv(AC)y is extracted by the coupling capacitor C2*m*, and is superimposed on a DC bias voltage Vmag(DC)m, as an AC bias voltage Vmag(AC)m. AC bias voltages Vmag(AC)c, Vmag(AC)k are applied to the magnetic rollers for use in printing images of cyan, black, respectively, in the similar manner as described above.

In this embodiment, the output voltage from the DC—DC converter P1 serving as the DC bias voltage Vmag(DC) to be applied to the magnetic roller 2 is changeable to realize Vmag(DC)=0 with respect to each of the colors, with use of the resistor R5, the resistor R21, the bias resistors R22, R23, and the transistor Q3. Further, the charged voltage of the capacitor C1 serving as the DC bias voltage Vslv(DC) to be applied to the developing roller 4 is regulated with respect to each of the colors, with use of the input resistor R05, the resistors R06, R07, the feedback resistor R08, the resistors R11, R12, the calculation amplifier A2, and the transistor Q4. In this arrangement, use of the single DC—DC converter P1 enables to smoothly switch over the operation of the bias voltage generator between the image formation period and the non image formation period independently of each other, as timed with a sheet transport operation.

Figure 7:
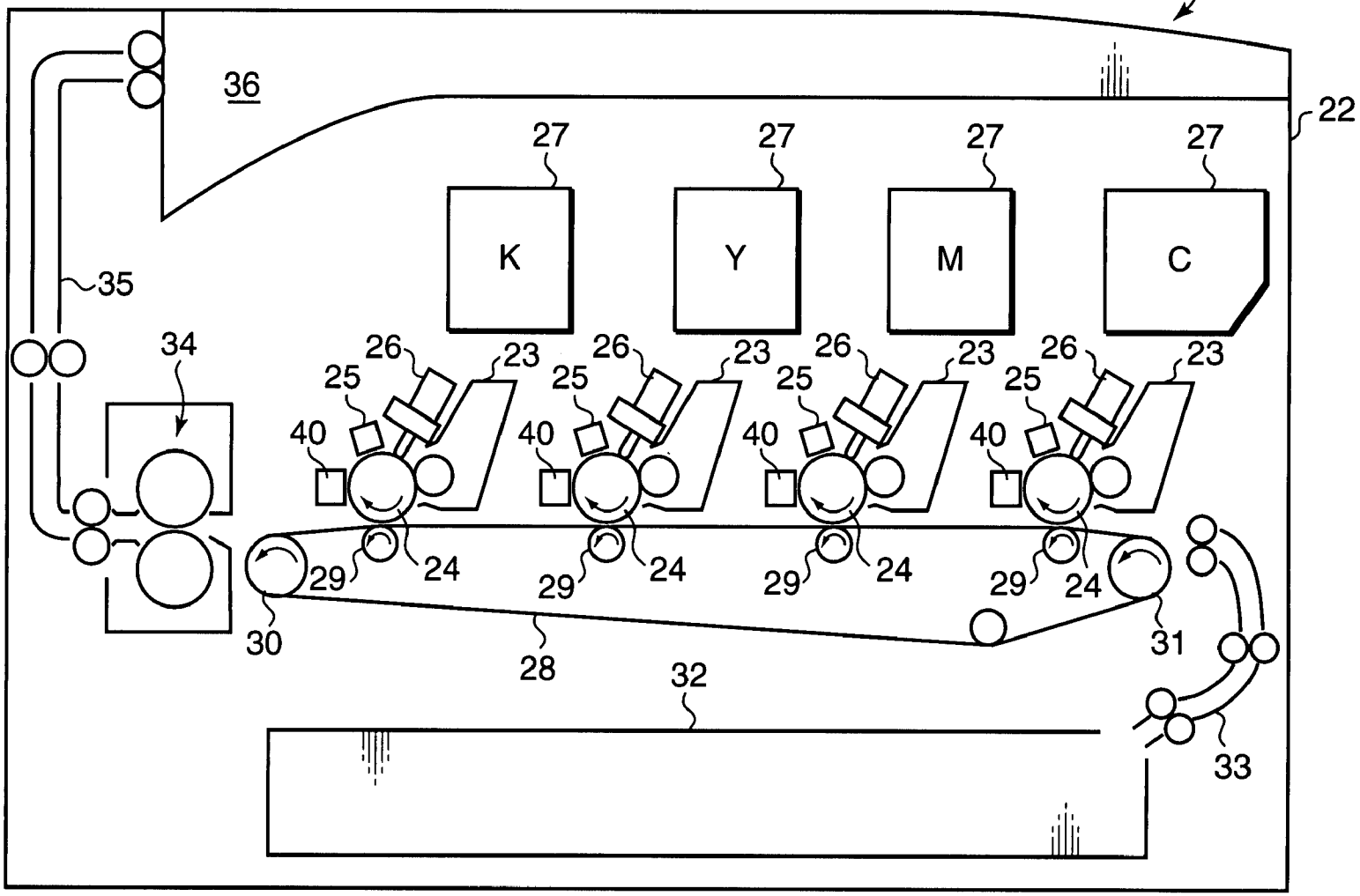
FIG. 7 is an illustration schematically showing an arrangement of an image forming apparatus loaded with a developing unit incorporated with the bias voltage generator as shown in FIG. 5.

FIG. 7 is an illustration schematically showing an image forming apparatus 21 loaded with developing units incorporated with the bias voltage generating circuits as shown in FIG. 5. The image forming apparatus 21 is a full-color reproducible image forming apparatus of a tandem system, and a main body 22 thereof has image forming stations adapted for forming images of respective colors of black (K), yellow (Y), magenta (M), and cyan (C). Each of the image forming stations is such that the surface of a photosensitive drum 24 is uniformly charged by a charger 25, accompanied by rotation of the photosensitive drum 24 in the direction shown by the arrow in FIG. 7. An electrostatic latent image is formed on each drum surface by irradiation of LED light which is emitted from an LED array head 26 based on image data outputted from an external apparatus such as a personal computer. The latent image is developed into a toner image by toner supply from each of the developing units 23. Toner is supplied from toner suppliers (toner cartridges) 27 containing toner of black, yellow, magenta, and cyan via the respective corresponding developing units 23. A sheet transport belt 28 is provided below the four photosensitive drums 24. The sheet transport belt 28 is rotated in the same direction as the rotating directions of the photosensitive drums 24, while being pressed against the photosensitive drums 24 by respective corresponding pressing rollers 29.

A sheet is transported between the photosensitive drums 24 and the sheet transport belt 28 from a sheet dispensing mechanism 32 along a sheet transport path 33. As the sheet is transported between the photosensitive drums 24 and the sheet transport belt 28, toner images of the respective colors are transferred onto the sheet successively from the surfaces of the respective photosensitive drums 24 by application of a transfer bias voltage. The sheet carrying the toner images transferred from all the photosensitive drums 24 is transported to a fixing unit 34 comprising a fixing roller pair where the toner images are thermally fixed by a nip defined by the fixing roller pair. Thereby, a color image is formed on the sheet. After passing the fixing unit 34, the sheet is transported to a sheet transport path 35, and discharged onto a sheet discharging section 36. A cleaning mechanism 40 is provided each in the vicinity of the corresponding photosensitive drum 24 to remove residual toner or the like from the drum surface.

The bias voltage generating circuits as shown in FIG. 5 are incorporated in the respective developing units 23 of the image forming apparatus 21. By adopting the arrangement as shown in FIG. 5, the single DC—DC converter P1 is commonly used among the developing units 23 for printing images of the respective four colors.

According to an aspect of the present invention, a developing unit constructed such that a thin layer of a developing agent is deposited on a developing roller by way of a magnetic brush formed on a magnetic roller, and the developing agent is transferred from the developing roller to a photosensitive drum for development, the developing unit comprising: first DC bias voltage generating means which generates a first DC bias voltage to be applied to the magnetic roller; second DC bias voltage generating means which generates a second DC bias voltage to be applied to the developing roller; first AC bias voltage generating means which generates a first AC bias voltage to be applied to the magnetic roller, the first AC bias voltage being superimposed on the first DC bias voltage; and second AC bias voltage generating means which generates a second AC bias voltage to be applied to the developing roller, the second AC bias voltage being superimposed on the second DC bias voltage, wherein the first AC bias voltage and the second AC bias voltage have frequencies identical to each other and phases reversed to each other.

The developing unit is adapted to an image forming apparatus of an electrophotographic system in which a two component developing agent is used, and includes a so-called hybrid developer equipped with dual rollers consisting of a magnetic roller and a developing roller. In the developing unit, if excessive charging or charging failure occurs regarding the developing agent such as toner, sufficient supply of the developing agent from the magnetic roller to the developing roller, and sufficient recovery of the developing agent from the developing roller to the magnetic roller are obstructed. To solve these drawbacks, in the above arrangement, the first and second DC bias voltage generating means, and the first and second AC bias voltage generating means are provided to generate the developing bias voltage to be applied to the magnetic roller, and the developing bias voltage to be applied to the developing roller by superimposing the first AC bias voltage on the first DC bias voltage, and the second AC bias voltage on the second DC bias voltage, respectively. Further, the frequencies of the first AC bias voltage to be applied to the magnetic roller, and the second AC bias voltage to be applied to the developing roller are made identical to each other and the phases thereof are reversed to each other.

In the above arrangement, an electric current alternately flows in the magnetic roller and the developing roller to accelerate transfer of the developing agent, thereby enabling to carry out sufficient supply of the developing agent from the magnetic roller to the developing roller, and sufficient recovery of the developing agent from the developing roller to the magnetic roller with application of a relatively low bias voltage. As compared with a case of applying an AC bias voltage merely to the developing roller, this arrangement enables to lower the amplitude of the AC bias voltage to thereby eliminate an influence on the photosensitive drum. Further, since the frequencies of the AC bias voltages to be applied to the magnetic roller and the developing roller are constant, this arrangement enables to produce the first and second AC bias voltage generating means at a low cost.

Preferably, the first DC bias voltage to be applied to the magnetic roller and the second DC bias voltage to be applied to the developing roller are set substantially equipotential to each other, and a negative component of the first AC bias voltage is extracted for output, during a non image formation period and a period between jobs of an image forming apparatus.

In the above arrangement, the first DC bias voltage to be applied to the magnetic roller, and the second DC bias voltage to be applied to the developing roller are made substantially equipotential to each other during the non image formation period such as a period when there is no image data, or a period when a region of a sheet other than an image recordable region passes the image forming section of the image forming apparatus, and the period between jobs of the image forming apparatus such as a period in-between successively transported sheets. Thereby, there is no or less variation in charged amount distribution of toner due to circulation of the toner between the developing roller and the magnetic roller. Further, this arrangement enables to prevent generation of a residual image resulting from continuous development, and to secure long-term and stable image formation by supply of the stably charged toner onto the developing roller. Further, since merely the negative component of the first AC bias voltage is extracted for output, recovery of the developing agent from the magnetic roller can be efficiently carried out while the developing agent is positively charged.

Preferably, the first DC bias voltage generating means, the first AC bias voltage generating means, and the second AC bias voltage generating means constitute a single voltage booster circuit incorporated with a transducer. The voltage booster circuit includes: the transducer; a signal source which generates an AC signal to be supplied to a primary wiring of the transducer; a rectifying diode which rectifies the boosted AC signal outputted from a secondary wiring of the transducer; resistors provided at respective one ends of series circuits constituted of the secondary wiring and the rectifying diode; capacitors arranged in parallel with the resistors, respectively; a switching element which passes a terminal voltage of said one of the resistors during a non image formation period; and a coupling capacitor which supplies the voltage passing the switching element, as the first AC bias voltage, to a power source line from the first DC bias voltage generating means to the magnetic roller to superimpose the first AC bias voltage on the first DC bias voltage, whereby an electric current loop is established by way of the rectifying diode to charge the capacitors with polarities thereof opposite to each other, and to output a voltage in which an induced voltage in the secondary wiring of the transducer is subtracted from a charged voltage at said other one of the capacitors, during one of a period when the AC signal is set high and a period when the AC signal is set low, with a connecting point of the secondary wiring of the transducer and the rectifying diode serving as an output end to the developing roller, a voltage in which the second AC bias voltage is added to the second DC bias voltage is outputted by adding the charged voltage at said other one of the capacitors to the induced voltage in the secondary wiring of the transducer during said other one of the period when the AC signal is set high and the period when the AC signal is set low, and a negative component of the first AC bias voltage is extracted for output by discharging said one of the capacitors during said other one of the period when the AC signal is set high and the period when the AC signal is set low by causing the switching element to turn on during the non image formation period.

In the above arrangement, the first DC bias voltage, the first AC bias voltage, and the second AC bias voltage can be generated with use of the single transducer.

Preferably, the developing unit is used in multiple pairs for color development, the first DC bias voltage generating means, the first AC bias voltage generating means, and the second AC bias voltage generating means in said each pair of the developing units constitute a single voltage booster circuit incorporated with a transducer; the voltage booster circuit includes: the transducer; a signal source which generates an AC signal to be supplied to a primary wiring of the transducer; a rectifying diode which rectifies the boosted AC signal outputted from a secondary wiring of the transducer; resistors provided at respective one ends of series circuits constituted of the secondary wiring and the rectifying diode; a coupling capacitor which supplies a terminal voltage of said one of the resistors, as the first AC bias voltage, to a power source line from the first DC bias voltage generating means of said other one of the developing unit pairs to the magnetic roller to superimpose the first AC bias voltage on the first DC bias voltage; and a capacitor provided in parallel with said other one of the resistors, whereby an electric current loop is established by way of the rectifying diode to charge the capacitor, and to output a voltage in which an induced voltage in the secondary wiring of the transducer is subtracted from a charged voltage at the capacitor, during one of a period when the AC signal is set high and a period when the AC signal is set low, with a connecting point of the secondary wiring of the transducer and the rectifying diode serving as an output end to the developing roller, a voltage in which the second AC bias voltage is added to the second DC bias voltage is outputted by adding the charged voltage at the capacitor to the induced voltage in the secondary wiring of the transducer during said other one of the period when the AC signal is set high and the period when the AC signal is set low, and a negative component of the first AC bias voltage is extracted for output during said other one of the period when the AC signal is set high and the period when the AC signal is set low by a rectifying operation of the rectifying diode of said other one of the developing unit pairs.

In the above arrangement, the first DC bias voltage, the first AC bias voltage, and the second AC bias voltage can be generated with use of the single transducer, and the arrangement particularly suitable for color development can be realized with a simplified construction.

According to another aspect of the present invention, provided is an image forming apparatus in which the developing unit having one of the above arrangements is used.

In the above arrangement, incorporating the developing unit in the image forming apparatus of the electrophotographic system in which the two component developing agent is used makes it possible to produce the developing unit capable of carrying out sufficient supply of the developing agent from the magnetic roller to the developing roller, and sufficient recovery of the developing agent from the developing roller to the magnetic roller at a low cost.

A development method according to yet another aspect of the present invention comprises depositing a thin layer of a developing agent on a developing roller by way of a magnetic brush formed on a magnetic roller, and transferring the developing agent from the developing roller to a photosensitive drum for development, wherein a bias voltage to be applied to the magnetic roller is generated by superimposing a first AC bias voltage on a first DC bias voltage; a bias voltage to be applied to the developing roller is generated by superimposing a second AC bias voltage on a second DC bias voltage; and the first AC bias voltage to be applied to the magnetic roller and the second AC bias voltage to be applied to the developing roller have frequencies identical to each other and phases reversed to each other.

The above method is adapted to the image forming apparatus of the electrophotographic system in which the two component developing agent is used. The development method is implemented with use of the so-called hybrid developer provided with dual rollers consisting of the magnetic roller and the developing roller. In the developing unit, if excessive charging or charging failure occurs regarding the developing agent such as toner, sufficient supply of the developing agent from the magnetic roller to the developing roller, and sufficient recovery of the developing agent from the developing roller to the magnetic roller are obstructed. To solve these drawbacks, in the above method, the developing bias voltage to be applied to the magnetic roller and the developing bias voltage to be applied to the developing roller are generated by superimposing the first AC bias voltage on the first DC bias voltage, and the second AC bias voltage on the second DC bias voltage, respectively. Further, the frequencies of the first AC bias voltage to be applied to the magnetic roller, and the second AC bias voltage to be applied to the developing roller are made identical to each other and the phases thereof are reversed to each other.

In the above method, an electric current alternately flows in the magnetic roller and the developing roller to accelerate transfer of the developing agent, thereby enabling to carry out sufficient supply of the developing agent from the magnetic roller to the developing roller, and sufficient recovery of the developing agent from the developing roller to the magnetic roller with application of a relatively low bias voltage. Accordingly, as compared with a case of applying an AC bias voltage merely to the developing roller, this method enables to lower the amplitude of the AC bias voltage to thereby eliminate an influence on the photosensitive drum. Further, since the frequencies of the AC bias voltages to be applied to the magnetic roller and the developing roller are constant, this method enables to produce the AC bias voltage generating means at a low cost.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A developing unit constructed such that a thin layer of a developing agent is deposited on a developing roller by way of a magnetic brush formed on a magnetic roller, and the developing agent is transferred from the developing roller to a photosensitive drum for development, the developing unit comprising:

first DC bias voltage generating means which generates a first DC bias voltage to be applied to the magnetic roller;

second DC bias voltage generating means which generates a second DC bias voltage to be applied to the developing roller;

first AC bias voltage generating means which generates a first AC bias voltage to be applied to the magnetic roller, the first AC bias voltage being superimposed on the first DC bias voltage; and second AC bias voltage generating means which generates a second AC bias voltage to be applied to the developing roller, the second AC bias voltage being superimposed on the second DC bias voltage, wherein the first AC bias voltage and the second AC bias voltage have frequencies identical to each other and phases reversed to each other.

2. The developing unit according to claim 1, wherein the first DC bias voltage to be applied to the magnetic roller and the second DC bias voltage to be applied to the developing roller are set substantially equipotential to each other, and a negative component of the first AC bias voltage is extracted for output, during a non image formation period and a period between jobs of an image forming apparatus.

3. The developing unit according to claim 1, wherein:

the first DC bias voltage generating means, the first AC bias voltage generating means, and the second AC bias voltage generating means constitute a single voltage booster circuit incorporated with a transducer;

the voltage booster circuit includes:

the transducer;

a signal source which generates an AC signal to be supplied to a primary wiring of the transducer;

a rectifying diode which rectifies the boosted AC signal outputted from a secondary wiring of the transducer;

resistors provided at respective one ends of series circuits constituted of the secondary wiring and the rectifying diode;

capacitors arranged in parallel with the resistors, respectively;

a switching element which passes a terminal voltage of said one of the resistors during a non image formation period; and a coupling capacitor which supplies the voltage passing the switching element, as the first AC bias voltage, to a power source line from the first DC bias voltage generating means to the magnetic roller to superimpose the first AC bias voltage on the first DC bias voltage, whereby an electric current loop is established by way of the rectifying diode to charge the capacitors with polarities thereof opposite to each other, and to output a voltage in which an induced voltage in the secondary wiring of the transducer is subtracted from a charged voltage at said other one of the capacitors, during one of a period when the AC signal is set high and a period when the AC signal is set low, with a connecting point of the secondary wiring of the transducer and the rectifying diode serving as an output end to the developing roller, a voltage in which the second AC bias voltage is added to the second DC bias voltage is outputted by adding the charged voltage at said other one of the capacitors to the induced voltage in the secondary wiring of the transducer during said other one of the period when the AC signal is set high and the period when the AC signal is set low, and a negative component of the first AC bias voltage is extracted for output by discharging said one of the capacitors during said other one of the period when the AC signal is set high and the period when the AC signal is set low by causing the switching element to turn on during the non image formation period.

4. The developing unit according to claim 1, wherein the developing unit is used in multiple pairs for color development, the first DC bias voltage generating means, the first AC bias voltage generating means, and the second AC bias voltage generating means in said each pair of the developing units constitute a single voltage booster circuit incorporated with a transducer;

the voltage booster circuit includes:

the transducer;

a signal source which generates an AC signal to be supplied to a primary wiring of the transducer;

a rectifying diode which rectifies the boosted AC signal outputted from a secondary wiring of the transducer;

resistors provided at respective one ends of series circuits constituted of the secondary wiring and the rectifying diode;

a coupling capacitor which supplies a terminal voltage of said one of the resistors, as the first AC bias voltage, to a power source line from the first DC bias voltage generating means of said other one of the developing unit pairs to the magnetic roller to superimpose the first AC bias voltage on the first DC bias voltage; and a capacitor provided in parallel with said other one of the resistors, whereby an electric current loop is established by way of the rectifying diode to charge the capacitor, and to output a voltage in which an induced voltage in the secondary wiring of the transducer is subtracted from a charged voltage at the capacitor, during one of a period when the AC signal is set high and a period when the AC signal is set low, with a connecting point of the secondary wiring of the transducer and the rectifying diode serving as an output end to the developing roller, a voltage in which the second AC bias voltage is added to the second DC bias voltage is outputted by adding the charged voltage at the capacitor to the induced voltage in the secondary wiring of the transducer during said other one of the period when the AC signal is set high and the period when the AC signal is set low, and a negative component of the first AC bias voltage is extracted for output during said other one of the period when the AC signal is set high and the period when the AC signal is set low by a rectifying operation of the rectifying diode of said other one of the developing unit pairs.

5. An image forming apparatus for use with a developing unit constructed such that a thin layer of a developing agent is deposited on a developing roller by way of a magnetic brush formed on a magnetic roller, and the developing agent is transferred from the developing roller to a photosensitive drum for development, the developing unit comprising:

first DC bias voltage generating means which generates a first DC bias voltage to be applied to the magnetic roller;

second DC bias voltage generating means which generates a second DC bias voltage to be applied to the developing roller;

first AC bias voltage generating means which generates a first AC bias voltage to be applied to the magnetic roller, the first AC bias voltage being superimposed on the first DC bias voltage; and second AC bias voltage generating means which generates a second AC bias voltage to be applied to the developing roller, the second AC bias voltage being superimposed on the second DC bias voltage, wherein the first AC bias voltage and the second AC bias voltage have frequencies identical to each other and phases reversed to each other.

6. The image forming apparatus according to claim 5, wherein the first DC bias voltage to be applied to the magnetic roller and the second DC bias voltage to be applied to the developing roller are set substantially equipotential to each other, and a negative component of the first AC bias voltage is extracted for output during a non image formation period and a period between jobs of the image forming apparatus.

7. The image forming apparatus according to claim 5, wherein the first DC bias voltage generating means, the first AC bias voltage generating means, and the second AC bias voltage generating means constitute a single voltage booster circuit incorporated with a transducer;

the voltage booster circuit includes:

the transducer;

a signal source which generates an AC signal to be supplied to a primary wiring of the transducer;

a rectifying diode which rectifies the boosted AC signal outputted from a secondary wiring of the transducer;

resistors provided at respective one ends of series circuits constituted of the secondary wiring and the rectifying diode;

capacitors arranged in parallel with the resistors, respectively;

a switching element which passes a terminal voltage of said one of the resistors during a non image formation period; and a coupling capacitor which supplies the voltage passing the switching element, as the first AC bias voltage, to a power source line from the first DC bias voltage generating means to the magnetic roller to superimpose the first AC bias voltage on the first DC bias voltage, whereby a connecting point of the secondary wiring of the transducer and the rectifying diode is served as an output end to the developing roller, then an electric current loop is established by way of the rectifying diode to charge the capacitors with polarities thereof opposite to each other, and a voltage subtracting an induced voltage in the secondary wiring of the transducer from a charged voltage at said other one of the capacitors is outputted, during one of a period when the AC signal is set high and a period when the AC signal is set low, a voltage in which the second AC bias voltage is added to the second DC bias voltage is outputted by adding the charged voltage at said other one of the capacitors to the induced voltage in the secondary wiring of the transducer during said other one of the period when the AC signal is set high and the period when the AC signal is set low, and a negative component of the first AC bias voltage is extracted for output by discharging said one of the capacitors during said other one of the period when the AC signal is set high and the period when the AC signal is set low by causing the switching element to turn on during the non image formation period.

8. The image forming apparatus according to claim 5, wherein the developing unit is used in multiple pairs for color development, the first DC bias voltage generating means, the first AC bias voltage generating means, and the second AC bias voltage generating means in said each pair of the developing units constitute a single voltage booster circuit incorporated with a transducer;

the voltage booster circuit includes:

the transducer;

a signal source which generates an AC signal to be supplied to a primary wiring of the transducer;

a rectifying diode which rectifies the boosted AC signal outputted from a secondary wiring of the transducer;

resistors provided at respective one ends of series circuits constituted of the secondary wiring and the rectifying diode;

a coupling capacitor which supplies a terminal voltage of said one of the resistors, as the first AC bias voltage, to a power source line from the first DC bias voltage generating means of said other one of the developing unit pairs to the magnetic roller to superimpose the first AC bias voltage on the first DC bias voltage; and a capacitor provided in parallel with said other one of the resistors, whereby a connecting point of the secondary wiring of the transducer and the rectifying diode is served as an output end to the developing roller, then an electric current loop is established by way of the rectifying diode to charge the capacitor, and a voltage subtracting an induced voltage in the secondary wiring of the transducer from a charged voltage at the capacitor is outputted, during one of a period when the AC signal is set high and a period when the AC signal is set low, a voltage in which the second AC bias voltage is added to the second DC bias voltage is outputted by adding the charged voltage at the capacitor to the induced voltage in the secondary wiring of the transducer during said other one of the period when the AC signal is set high and the period when the AC signal is set low, and a negative component of the first AC bias voltage is extracted for output during said other one of the period when the AC signal is set high and the period when the AC signal is set low by a rectifying operation of the rectifying diode of said other one of the developing unit pairs.

9. A development method comprising depositing a thin layer of a developing agent on a developing roller by way of a magnetic brush formed on a magnetic roller, and transferring the developing agent from the developing roller to a photosensitive drum for development, wherein a bias voltage to be applied to the magnetic roller is generated by superimposing a first AC bias voltage on a first DC bias voltage;

a bias voltage to be applied to the developing roller is generated by superimposing a second AC bias voltage on a second DC bias voltage; and the first AC bias voltage to be applied to the magnetic roller and the second AC bias voltage to be applied to the developing roller have frequencies identical to each other and phases reversed to each other.

10. The development method according to claim 9, wherein the first DC bias voltage to be applied to the magnetic roller and the second DC bias voltage to be applied to the developing roller are set substantially equipotential to each other, and a negative component of the first AC bias voltage is extracted for output during a non image formation period and a period between jobs of an image forming apparatus.

* * * * *